US007673476B2

(12) United States Patent
Whitesell

(10) Patent No.: US 7,673,476 B2
(45) Date of Patent: Mar. 9, 2010

(54) COMPACT, MODULAR METHOD AND APPARATUS FOR LIQUEFYING NATURAL GAS

(75) Inventor: Robert Whitesell, Fairfield, OH (US)

(73) Assignee: Cambridge Cryogenics Technologies, Henderson, NV (US)

( * ) Notice: Subject to any disclaimer, the term of this patent is extended or adjusted under 35 U.S.C. 154(b) by 418 days.

(21) Appl. No.: 11/388,087

(22) Filed: Mar. 23, 2006

(65) Prior Publication Data

US 2006/0213222 A1 Sep. 28, 2006

Related U.S. Application Data

(60) Provisional application No. 60/665,666, filed on Mar. 28, 2005.

(51) Int. Cl.
*F25J 1/00* (2006.01)

(52) U.S. Cl. ..... 62/613

(58) Field of Classification Search ..... 62/613, 62/612

See application file for complete search history.

(56) References Cited

U.S. PATENT DOCUMENTS 2,903,858 A * 9/1959 Bocquet ..... 62/613
3,360,944 A * 1/1968 Markbreiter et al. ..... 62/613
3,383,873 A 5/1968 Becker
3,413,817 A * 12/1968 Ludwig ..... 62/613
3,531,942 A * 10/1970 Fleur ..... 62/613
3,616,652 A 11/1971 Engel
3,677,019 A 7/1972 Olszewski
3,735,600 A 5/1973 Dowdell et al.
4,046,493 A * 9/1977 Alund ..... 417/220
4,195,979 A * 4/1980 Martin ..... 62/613
4,456,459 A 6/1984 Brundige, Jr.
4,541,852 A * 9/1985 Newton et al. ..... 62/613
4,551,080 A * 11/1985 Geiger ..... 418/28
4,970,867 A 11/1990 Herron et al.
5,036,671 A 8/1991 Nelson et al.
5,473,900 A 12/1995 Low
5,755,114 A 5/1998 Foglietta
5,836,173 A 11/1998 Lynch et al.
6,062,041 A * 5/2000 Kikkawa et al. ..... 62/613
6,085,545 A 7/2000 Johnston
6,085,546 A 7/2000 Johnston
6,085,547 A 7/2000 Johnston (Continued)

*Primary Examiner*—William C Doerrler
(74) *Attorney, Agent, or Firm*—Ronald J. Richter; Daniel F. Nesbitt; Hasse & Nesbitt LLC

(57) ABSTRACT

A compact and modular cryogenic method and apparatus for liquefying natural gas. The liquefaction process is highly efficient and requires no external refrigeration system, and the apparatus is small enough to be transportable from one remote site to another. A compressed natural gas feed stream is cooled and then expanded to form a bi-phase stream comprising a first refrigerated vapor component and a first liquid component. The first liquid component is then separated from the bi-phase stream and expanded to form a second bi-phase stream comprising a second refrigerated vapor component and a second liquid component. The second liquid component is then introduced into a means configured for storage and transport. The remaining feed stream can then be recycled, and at least a substantial portion of the original feed stream can be processed into liquefied natural gas (LNG). The first and second vapor components are recycled through the system and comprise at least a portion of the feed stream in the repeated steps.

17 Claims, 7 Drawing Sheets

U.S. PATENT DOCUMENTS 6,196,021 B1 * 3/2001 Wissolik ..... 62/606
6,269,656 B1 8/2001 Johnston
6,367,286 B1 * 4/2002 Price ..... 62/613
6,378,330 B1 4/2002 Minta et al.
6,460,350 B2 10/2002 Johnson et al.
6,564,578 B1 * 5/2003 Fischer-Calderon ..... 62/613
6,581,409 B2 6/2003 Wilding et al.
6,743,829 B2 6/2004 Fischer-Calderon et al.
6,751,985 B2 6/2004 Kimble et al.
6,886,362 B2 5/2005 Wilding et al.
6,962,061 B2 11/2005 Wilding et al.
7,078,012 B2 7/2006 Bingham et al.
7,234,321 B2 * 6/2007 Maunder et al. ..... 62/613

* cited by examiner

COMPACT, MODULAR METHOD AND APPARATUS FOR LIQUEFYING NATURAL GAS

CROSS-REFERENCE TO RELATED APPLICATION

This application claims the benefit of U.S. Provisional Application No. 60/665,666, filed on Mar. 28, 2005.

FIELD OF THE INVENTION

The present invention relates in general to cryogenic refrigeration cycles useful in many commercial and industrial applications including the liquefaction of gases.

BACKGROUND OF THE INVENTION

There are numerous reasons for the liquefaction of gases, including naturally occurring gases such as methane. Perhaps the chief reason is that liquefaction greatly reduces the volume of a gas, making it feasible to store and transport the liquefied gas in containers of improved economy and design. Liquid gases can be stored in suitably designed cryogenic containers and dispensed into vehicle tanks using techniques that have been in use for many years in the industrial cryogenic gas industries.

Many industrial gases such as propane, butane and carbon dioxide can be liquefied by placing them under very high pressure. However, producing liquid from methane may not be achieved with high pressure alone. To this extent, methane, a cryogenic gas, is different from other industrial gases. To liquefy methane it is typically necessary to reduce the temperature of the gaseous phase to below about −160° C., depending upon the pressure at which the process is operated.

Numerous systems exist in the prior art for the production of liquefied natural gas ("LNG"). Conventional processes known in the art require substantial refrigeration to reduce the gas to liquid and maintain it at its liquefaction temperature. Among the most common of these refrigeration processes are: (1) the cascade process; (2) the single mixed refrigerant process; and (3) the propane pre-cooled mixed refrigerant process.

The cascade process produces liquefied gases by employing several closed-loop cooling circuits, each utilizing a single pure refrigerant and collectively configured in order of progressively lower temperatures. The first cooling circuit commonly utilizes propane or propylene as the refrigerant; the second circuit may utilize ethane or ethylene, while the third circuit generally utilizes methane as the refrigerant.

The single mixed refrigerant process produces LNG by employing a single closed-loop cooling circuit utilizing a multi-component refrigerant consisting of components such as nitrogen, methane, ethane, propane, butanes and pentanes. The mixed refrigerant undergoes the steps of condensation, expansion and recompression to reduce the temperature of natural gas by employing a unitary collection of heat exchangers known as a "cold box."

The propane pre-cooled mixed refrigerant process produces LNG by employing an initial series of propane-cooled heat exchangers in addition to a single closed-loop cooling circuit, which utilizes a multi-component refrigerant consisting of components such as nitrogen, methane, ethane and propane. Natural gas initially passes through one or more propane-cooled heat exchangers, proceeds to a main exchanger cooled by the multi-component refrigerant, and is thereafter expanded to produce LNG.

Most liquefaction plants utilize one of these gas liquefaction processes. Unfortunately, the cost and maintenance of such plants is expensive because of the cost of constructing, operating and maintaining one or more external, single or mixed refrigerant, closed-loop cooling circuits. Such circuits typically require the use and storage of multiple highly explosive refrigerants that can present safety concerns. Refrigerants such as propane, ethylene and propylene are explosive, while propane and propylene, in particular, are heavier than air, further complicating dispersion of these gases in the event of a leak or other equipment failure. It would therefore be beneficial to eliminate the external refrigeration circuit(s) in a liquefaction plant.

One of the distinguishing features of a conventional liquefaction plant in the prior art is the large capital investment required. The equipment used to liquefy cryogenic gases in high volumes is large, complex and very expensive. The plant is typically made up of several basic systems, including a gas treatment system (to remove impurities from the initial feed stream), and liquefaction, refrigeration, power, storage and loading facilities. Materials required in conventional liquefaction plants also contribute greatly to the plants' cost. Containers, long runs of piping, and multiple-level tiers of other equipment are principally constructed from aluminum, stainless steel or high nickel content steel to provide the necessary strength and fracture toughness at low temperatures. It would therefore be beneficial to decrease the initial amount of capital investment needed to form a liquefaction plant.

Another distinguishing feature of a conventional liquefaction plant in the prior art is that as a result of its complexity and size, the plant, by necessity, is typically a fixed installation that can not be easily relocated. Even if a conventional plant can be physically relocated, such a move is very costly and requires the plant to be out of service for many months while plant systems, components and structures are disassembled, moved and then reassembled on a newly prepared site. It would therefore be beneficial to provide a liquefaction plant that is small and simple in design so that it can be easily relocated without significant operational down time.

There exists a multitude of current prior art methods for the liquefaction of natural gas. For example, U.S. Pat. No. 5,755,114 to Foglietta discloses a hybrid liquefaction cycle for the production of LNG. The Foglietta process passes a pressurized natural gas feed stream into heat exchange contact with a closed-loop propane or propylene refrigeration cycle prior to directing the natural gas feed stream through a turboexpander cycle to provide auxiliary refrigeration. The Foglietta process requires at least one external closed-loop refrigeration cycle comprising propane or propylene, both of which are explosive.

The system of U.S. Pat. No. 6,085,545 to Johnston first compresses the natural gas feed (typically methane) which then passes through an after-cooler to remove the heat of compression. At this point the natural gas flow is split into two flow portions, the first of which is cooled in at least one heat exchanger and then throttled into a collector, and the second of which enters a turboexpander wherein the temperature and pressure are lowered and the work of expansion is extracted. The second flow portion is then used in at least one heat exchanger as the heat exchange cooling medium.

U.S. Pat. No. 3,616,652 to Engel discloses a process for producing LNG in a single stage by compressing a natural gas feed stream, cooling the compressed natural gas feed stream to form a liquefied stream, dramatically expanding the liquefied stream to an intermediate-pressure liquid, and then flashing and separating the intermediate-pressure liquid in a single separation step to produce LNG and a low-pressure flash gas.

The low-pressure flash gas is recirculated, substantially compressed and reintroduced into the intermediate pressure liquid. While the Engel process produces LNG without the use of external refrigerants, the process yields a small volume of LNG compared to the amount of work required for its production, thus limiting the economic viability of the process.

While these prior art inventions may be sufficient for the particular problems that they solve, it would be beneficial in the industry to provide an improved process for the cryogenic refrigeration and liquefaction of gases. It would also be beneficial to eliminate the external refrigeration circuit(s) in a liquefaction plant. It would be likewise be advantageous to decrease the initial amount of capital investment needed to form a liquefaction plant. It would also be advantageous to provide a liquefaction plant that is small and simple in design so that it can be easily relocated without significant operational down time.

SUMMARY OF THE INVENTION

Accordingly, the present invention relates to a compact and modular method and apparatus for the liquefaction of gas, typically methane gas, in a single, highly efficient step involving no external or separate refrigeration system. The apparatus is environmentally safe, compact, and modular, such that it is cost-efficient to move the entire apparatus from one location to another in several days' time.

A first aspect of the invention relates to a method for liquefying a compressed gas feed stream, the method comprising the steps of providing a compressed gas feed stream at a pressure of between about 1,500 psig to about 3,500 psig; cooling the feed stream to between about −10° F. to about −100° F.; expanding the cooled feed stream to form a first bi-phase stream comprising a first refrigerated vapor component and a first liquid component; separating the first refrigerated vapor component and the first liquid component; expanding the separated first liquid component to form a second bi-phase stream comprising a second refrigerated vapor component and a second liquid component; separating the second refrigerated vapor component and the second liquid component; and isolating the separated second liquid component to a means configured for storage and transport.

A second aspect of the invention relates to a compact and modular apparatus for refrigerating and liquefying a gas such as pure methane or a natural gas stream rich in methane, the apparatus comprising a means for cooling a compressed main feed stream entering at a pressure between about 1500 psig to about 3500 psig and at near ambient temperature to a temperature of between about −10° F. to about −100° F.; a turboexpander configured to expand the cooled, compressed feed stream to form a first bi-phase stream comprising a first refrigerated vapor component and a first liquid component; a primary separation tank configured to separate the first refrigerated vapor component and the first liquid component; a means configured to expand the separated first liquid component to form a second bi-phase stream comprising a second refrigerated vapor component and a second liquid component; a secondary separation tank configured to separate the second refrigerated vapor component and the second liquid component; and a means configured for storage and transport of the separated second liquid component.

A third aspect of the invention relates to a compact and modular apparatus for refrigerating and liquefying a gas such as pure methane or a natural gas stream rich in methane, the apparatus comprising (a) a multistage compressor configured for receiving and compressing a main stream gas at a pressure of about 85 psig and at near ambient temperature to a pressure of between about 1500 psig to about 3500 psig; (b) an aftercooler configured to cool the compressed feed stream to near ambient temperature immediately after each compression stage in the multistage compressor; (c) a heat exchanger configured to cool the compressed feed stream to a temperature of between about −10° F. to about −100° F., typically between about −20° F. to about −60° F., and more typically about −30° F.; (d) a turboexpander configured to expand the compressed and cooled feed stream to a pressure of between about 15 to about 135 psig, typically between about 80 to about 105 psig, and more typically to between about 90 to about 95 psig, to form a first refrigerated vapor component and a first liquid component having a temperature of between about −155° F. to about −240° F., typically about −190° F. to about −215° F. , and more typically about −200° F. to about −205° F.; (e) a primary separation tank configured to separate the first refrigerated vapor component and the first liquid component; (f) a throttle valve configured to expand the first liquid component to a pressure of between about 3 psig to about 7 psig, and more typically to about 5 psig to form a second refrigerated vapor component and a second liquid component having a temperature of between about −250° F. to −265° F., and typically between about −252° F. to about −258° F.; (g) a secondary separation tank configured to separate the second refrigerated vapor component and the second liquid component; (h) a means configured for storage and transport of the separated second liquid component; and (i) a means to place the separated first refrigerated vapor component and the separated second refrigerated vapor component into fluid communication with the compressed main feed stream.

In one embodiment, a regeneration heat exchanger (evaporator) receives the second liquid component as a cooling component therein and is operable to refrigerate an incoming line for a separate apparatus at a temperature of about −245° F., and the second liquid component, the first refrigerated vapor component, and the second refrigerated vapor component are recycled and combined with the feed stream of the closed loop system. In another similar embodiment there is only one expansion means (i.e. the turboexpander), and the regeneration heat exchanger is operable to refrigerate the incoming line for a separate apparatus at a temperature of about −185° F.

A further understanding of the nature and advantages of the present invention will be more fully appreciated with respect to the following drawings and detailed description.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE INVENTION

Definitions:

As used herein, the term "ambient temperature" refers to the temperature of the air surrounding an object. Typically the outdoor ambient temperature is generally between about 0 to 110 degrees Fahrenheit (° F.) (−18 to 43 degrees Celsius (° C.)).

The term "cryogenic gas" as used herein refers to a substance which is normally a gas at ambient temperature that can be converted to a liquid by pressure and/or cooling. A cryogenic gas typically has a boiling point of equal to or less than about −130° F. (−90° C.) at atmospheric pressure.

The terms "liquefied natural gas" or "LNG" as used herein refers to natural gas that is reduced to a liquefied state at or near atmospheric pressure.

The term "natural gas" as used herein refers to raw natural gas or treated natural gas. Raw natural gas is primarily comprised of light hydrocarbons such as methane, ethane, propane, butanes, pentanes, hexanes and impurities like benzene, but may also contain small amounts of non-hydrocarbon impurities, such as nitrogen, hydrogen sulfide, carbon dioxide, and traces of helium, carbonyl sulfide, various mercaptans or water. Treated natural gas is primarily comprised of methane and ethane, but may also contain small percentages of heavier hydrocarbons, such as propane, butanes and pentanes, as well as small percentages of nitrogen and carbon dioxide.

As used herein, "pressure" refers to a force acting on a unit area. Pressure is usually shown as pounds per square inch (psi). "Atmospheric pressure" refers to the local pressure of the air. As used herein, local atmospheric pressure is assumed to be 14.7 psia, the standard atmospheric pressure at sea level. "Absolute pressure" (psia) refers to the sum of the atmospheric pressure plus the gage pressure (psig). "Gage pressure" (psig) refers to the pressure (pounds per square inch) measured by a gage, and indicates the pressure exceeding the local atmospheric pressure. Kilopascals (kPa) is the International measure of pressure.

Description

In general, the present invention provides a highly-efficient, compact and modular apparatus for refrigerating and liquefying natural gas, typically pure methane or a gas stream rich in methane. The apparatus of the present invention is generally self-cooling, includes a lighter-than-air refrigerant (methane) in the heat exchange process, and requires no external refrigeration system.

Figure 1:
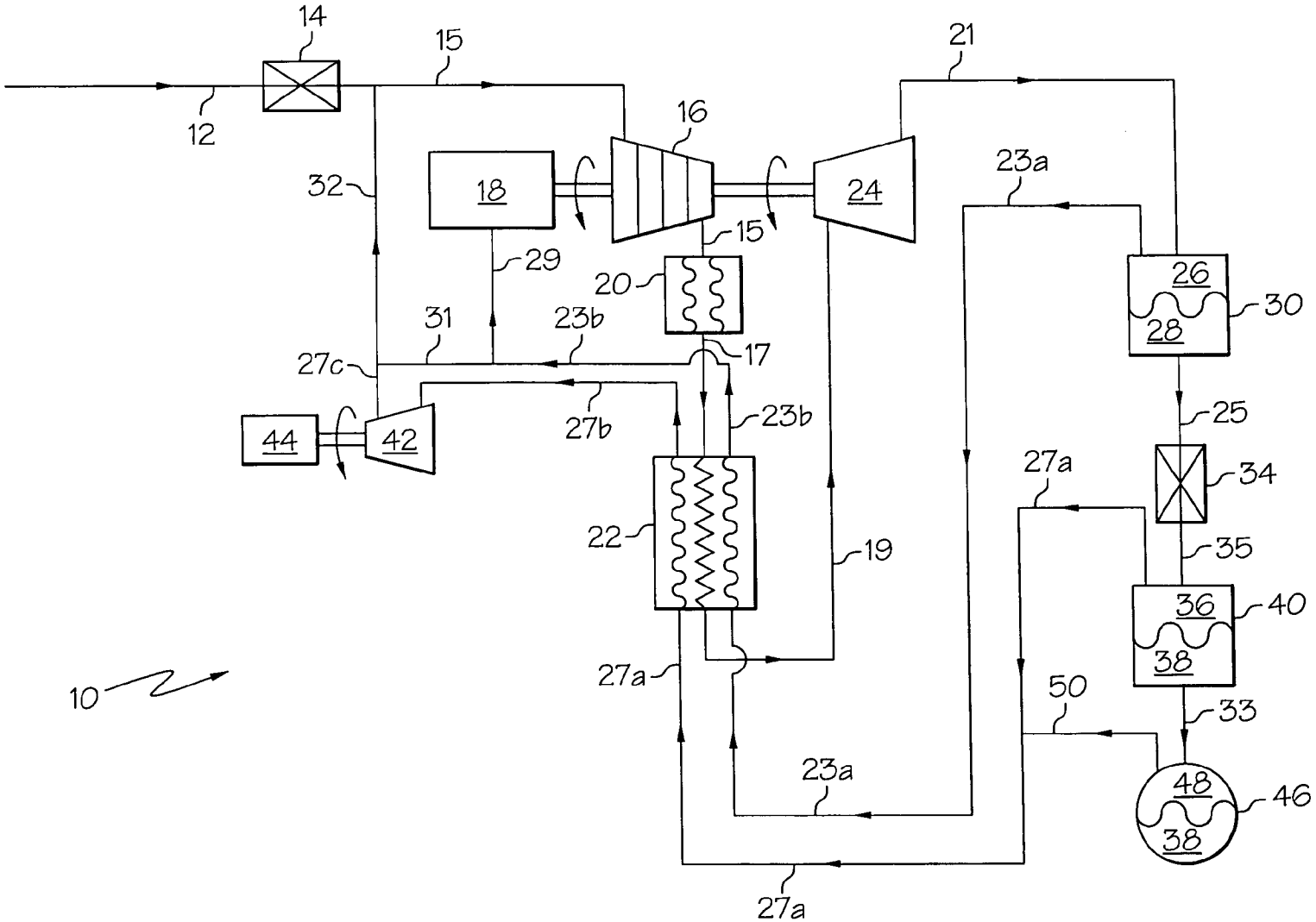
FIG. 1 is a schematic flow diagram showing a liquefaction system according to one embodiment of the present invention.

Referring to FIG. 1, a schematic flow diagram shows a liquefaction system 10 for liquefying a feed stream 12 that is rich in methane. The original feed stream 12 enters the system through a feed gas compressor inlet point 14 at a relatively low pressure, typically at 85 psig. Inlet point 14 can be either a compressor or a throttle valve used to standardize the incoming pressure of the original feed stream 12 to provide feed stream 15. Feed stream 15 then enters the liquefaction process, and will typically require further pressurization by one or more stages of compression. This compression is typically accomplished via a multi-stage feed gas compressor 16, which is typically driven by a natural gas engine driver 18. After each compression stage within the multi-stage compressor 16, the compressed vapor is cooled, typically by at least one conventional air or water after-cooler. For ease of illustrating this process, FIG. 1 shows the multi-stage compressor 16 as a single unit working in combination with a single after-cooler 20 to immediately cool feed stream 15 after each stage of compression. In actuality the stream makes one pass through the after-cooler 20 following each stage of the multi-stage compressor16, so that the stream is cooled to about ambient temperature before entering the next stage of compression.

After leaving the multi-stage compressor 16/after-cooler 20 combination, the pressurized feed stream 17 has typically been compressed multiple times and also cooled to near ambient temperature after each compression. Stream 17 is then further cooled to between about −10° F. to about −100° F. by being passed through a multi-flow cryogenic heat exchanger 22. Thereafter, the compressed and cooled feed stream 19 is expanded in a turboexpander 24 to lower the pressure, cool it further, and convert the previously gaseous feed stream 19 to a bi-phase stream 21 consisting of a first refrigerated vapor component 26 and a first liquid component 28, which are collected into a primary separation tank 30. The primary separation tank 30 separates vapor component 26 from liquid component 28, and vapor component 26 is then re-cycled through the system as first recovery vapor stream 23*a*.

Stream 23*a* is directed back to the multi-flow cryogenic heat exchanger 22 to help cool the pressurized feed stream 17 by indirect heat exchange, so that the compressed and cooled stream 19 exiting the heat exchanger 22 is substantially cooler than the pressurized feed stream 17 which is typically near ambient temperature. Typically, after the first few passes of the feed stream through the system 10, the heat exchanger 22 becomes more efficient in its ability to cool feed stream 17 before passing it on to the turboexpander 24. This initial cooling of the compressed feed stream 17 by the heat exchanger 22 typically decreases the temperature of the gaseous feed stream 19 to between about −10° F. to about −100° F.

Returning to the first separation tank 30, the first liquid component 28 exits as primary liquid stream 25 and is passed through a throttle valve 34. Valve 34 expands and lowers the pressure of liquid stream 25 to form another bi-phase discharge stream 35 which passes to a secondary separation tank 40. Bi-phase stream 35 consists of a second refrigerated vapor component 36 and a second liquid component 38, which are separated after collection in secondary separation tank 40. The second vapor component 36 is then directed out of the secondary separation tank 40 to be re-cycled through the system as second recovery vapor stream 27*a*. Vapor stream 27*a*, like the first recovery stream 23*a*, is directed back to the multi-flow cryogenic heat exchanger 22 to help cool feed stream 17 by indirect heat exchange. However, second recovery stream 27*a*, having passed through the throttle valve 34, is at a much lower pressure than the first recovery vapor stream 23*a*. Therefore after vapor stream 27*a* exits the heat exchanger 22 as stream 27*b*, it is typically recompressed with a lift or booster compressor 42, thereafter exiting as stream 27*c*. Stream 27*c* joins with stream 31 and returning as recycle stream 32 to the point of origin of the main feed stream 15, to begin the journey through the system 10 once again. The booster compressor 42 is typically driven by a motor 44.

Returning to the first recovery stream 23*a*, it enters the heat exchanger 22 to additionally cool stream 17 and then exits as stream 23*b*. As it exits the heat exchanger 22, stream 23*b* is typically split into two streams 29 and 31. Stream 29 is sent to help fuel the natural gas engine driver 18 that is used to drive the feed gas compressor 16, and stream 31 joins stream 27*c* as it exits the booster compressor 42 to become recycle stream 32. Recycle stream 32 then joins feed stream 15 upstream of the feed gas compressor 16.

Returning to the secondary separation tank 40, the second liquid component 38 is introduced as stream 33 into a storage/transport vessel or container 46 for LNG storage, transport and/or use. Optionally, as shown in FIG. 1, any additional vapor component 48 that develops within the storage vessel 46 forms a third recovery vapor stream 50 that can be combined with stream 27*a* and then recycled through the system. A pressure regulator or check valve (not shown) is typically included at line 50 to prevent backflow into the storage vessel 46. As a further option, the secondary separation tank 40 can be combined with storage vessel 46.

The process of the present invention typically includes the steps of passing the original natural gas feed stream 12 through the inlet point 14 to provide feed stream 15 at a relatively low pressure of between about zero to about 500 psig, typically between about 50 psig to about 110 psig, and more typically at about 85 psig. Before feed stream 15 can enter the liquefaction process, it will typically require further pressurization by one or more stages of compression to obtain a preferred pressure. Thus, as shown in FIG. 1, feed stream 15 is compressed and then cooled, typically multiple times within the combination multistage compressor 16/after-cooler 20, to achieve a much higher pressure, between about 1500 psig to about 3500 psig, typically between about 2000 psig to 2600 psig, and more typically to about 2485 psig, depending on the initial feed stream pressure. The multi-stage feed gas compressor 16 is typically driven by the natural gas engine driver 18. Although the feed stream 15 typically undergoes these multiple stages of compression, it will be understood by those of skill in the art that the compression stages would not be necessary if the feed natural gas is initially made available at a pressure of about 1500 psig or higher.

After feed stream 15 passes through the multi-stage compressor 16 and after-cooler 20, the fluid exits as feed stream 17 at about ambient (outside air) temperature, which is typically between about 0 (zero) degrees Fahrenheit (° F.) to about 110° F., (which corresponds roughly to about −18 degrees Celsius (° C.) to about 43° C.). Feed stream 17 is then further cooled by the multi-flow heat exchanger 22 and exits still primarily a vapor as stream 19, at a temperature of between about −10° F. to about −100° F., typically between about −20° F. to about −609° F., and more typically about −30° F.

The compressed and cooled feed stream 19 then passes to the expander 24. The expander 24 may be of any appropriate type capable of sufficiently lowering the pressure and temperature of the feed stream by extracting work from the expander. A positive displacement piston expander, a turboexpander, and a radial vane expander are non-limiting examples of known expanders that can be used in the method and apparatus of the invention. In addition, a sliding vane turboexpander capable of operation with bi-phase flow conditions can be used. Stream 19 enters the turboexpander 24 and exits as bi-phase feed stream 21 at a pressure of between about 15 to about 135 psig, typically between about 80 to about 105 psig, and more typically to between about 90 to about 95 psig. Bi-phase feed stream 21 enters the primary separation tank 30 as a first refrigerated vapor component 26 and a first liquid component 28. Each component 26, 28 typically has a temperature of between about −155° F. to about −240° F., typically about −190° F. to about −215° F. , and more typically about −200° F. to about −205° F.

The first liquid component 28 is passed as primary liquid stream 25 through throttle valve 34 and exits as bi-phase stream 35 at a pressure of between about 3 to about 7 psig, and more typically to about 5 psig to produce the second refrigerated vapor component 36 and second liquid component 38, each of which are typically at a temperature of between about −250° F. to −265° F., and typically between about −252° F. to about −258° F. The second liquid component 38 is then transferred to the storage vessel 46, typically at a temperature of about −260° F. and a pressure of about 5 psig.

Between about 10 percent to about 40 percent, typically between about 22 percent to about 32 percent, and more typically between about 24 percent to about 28 percent of the original feed gas stream 15 entering the liquefaction process is converted to liquid, with the natural gas that is reduced to liquid being replaced by the original incoming feed stream 12 at the feed gas compressor inlet point 14 in a continuously flowing process.

The present invention takes advantage of any extra energy and cooling produced in the system and transfers this energy and/or cooling to different parts of the system. For example, as illustrated in FIG. 1, at least a portion of the energy required for the multi-stage compressor 16 can be derived from the energy produced from the turboexpander 24. Further, at least a portion of the first refrigerated vapor component 26 can be transferred from first recovery stream 23*a* to line 29 to fuel the natural gas driver 18. The intent of configuring the fuel stream for the driver 18 from this point is to prevent non-liquefied pollutant levels in the closed loop portion of the system from accumulating to a level that would inhibit the process. As can also be seen in FIG. 1, at least a portion of the cooling in the multi-flow heat exchanger 22 is derived from both the first and second refrigerated vapor components via recovery streams 23*a* and 27*a*.

The overall ratio and quantity of gas reduced to liquid per pass through the system is typically dependent upon the level of high compression pressure, feed stream gas composition, turboexpander efficiency, and overall pressure differential between high pressure and low pressure. The optimal overall system efficiency and low pressure to high pressure ratio is dependent upon a number of factors determined by the types and capabilities of the various equipment used within the system. Net reduction ratios of between 20 and 30 percent (%) per pass through system can be expected with currently available commercial ancillary equipment. System horsepower input per gallon of LNG reduced from the methane feed stream could be expected to average approximately 1.4 to 1.6. For example, the system illustrated in FIG. 1 uses a combination of about 85 psig feed gas pressure at stream 15 and about 2,485 psig compressed high pressure at stream 19 to form a net liquid yield of 26 percent per pass through the system. These numbers are for illustrative purposes only and the system design and application are not limited to this combination.

Figure 2:
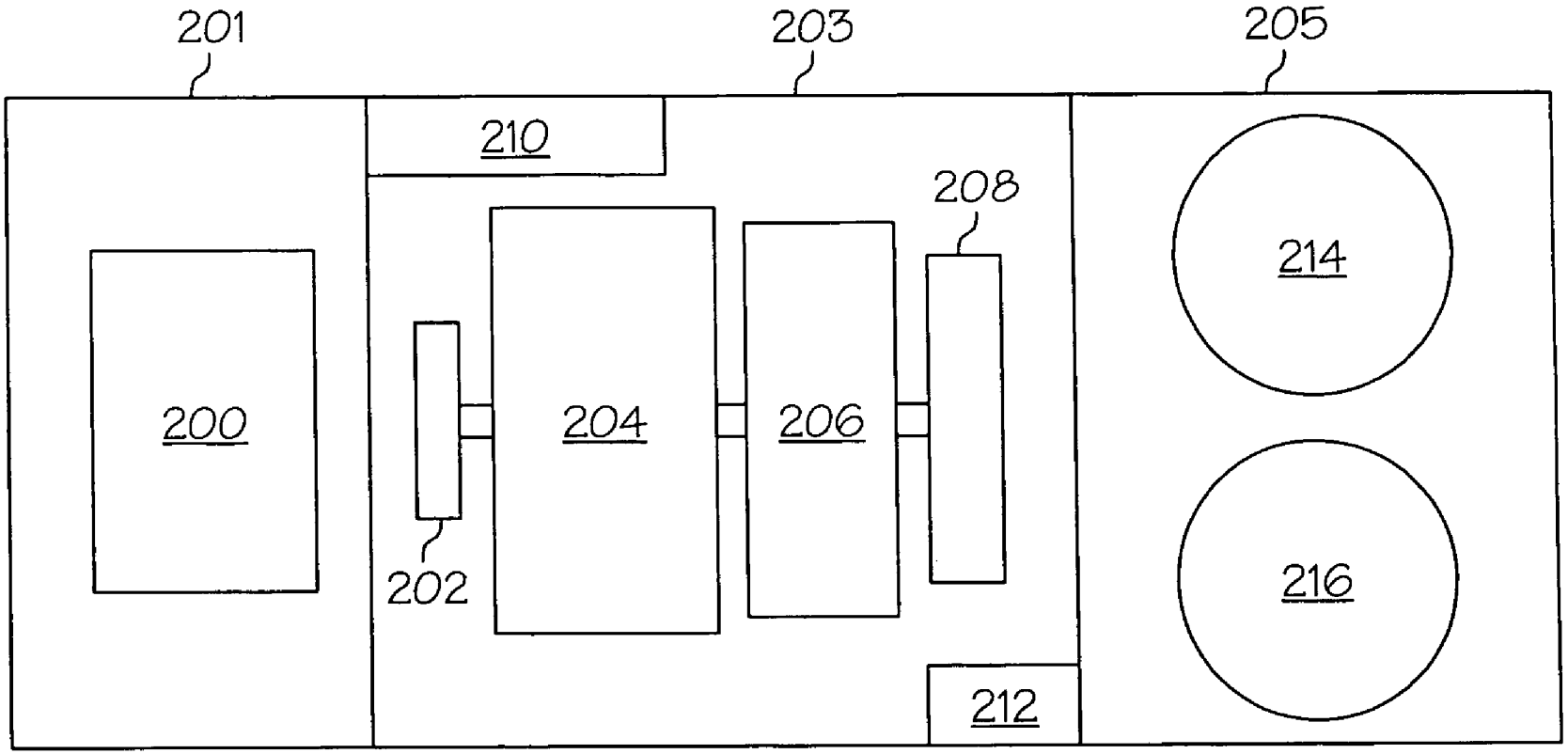
FIG. 2 is a diagram of a typical compact modular liquefaction plant according to one embodiment of the present invention.

The liquefaction plant of the present invention is intended to be easily relocated from one natural gas site to another without significant operational down time. In one embodiment, the apparatus can be loaded onto skids or into trucks for transport to a remote site. As illustrated in FIG. 2, three skids 201, 203, 205 can be used to transport the apparatus, with skid 201 primarily transporting after-coolers and the system's auxiliary coolers 200, skid 203 transporting most of the liquefaction equipment, and skid 205 transporting the primary and secondary separation tanks 214, 216. The liquefaction equipment skid 203 typically includes an electrical generator or alternator 202, a natural gas driver 204, the multistage compressor 206, a turboexpander 208, and a booster compressor 212. Control Panel 210 contains the main computer or programmable logic controller (PLC) for operating the apparatus. For a system that is capable of producing about 1000 to about 1100 U.S. gallons of LNG per hour, skid 201 is typically about 28 feet long and 12 feet wide and weighs approximately 30 (thirty) tons; skid 203 is typically about 33 feet long and 12 feet wide and weighs approximately 60 (sixty) tons; and skid 205 is typically about 28 feet long. and 12 feet wide and weighs about 34 (thirty-four) tons.

Figure 3:
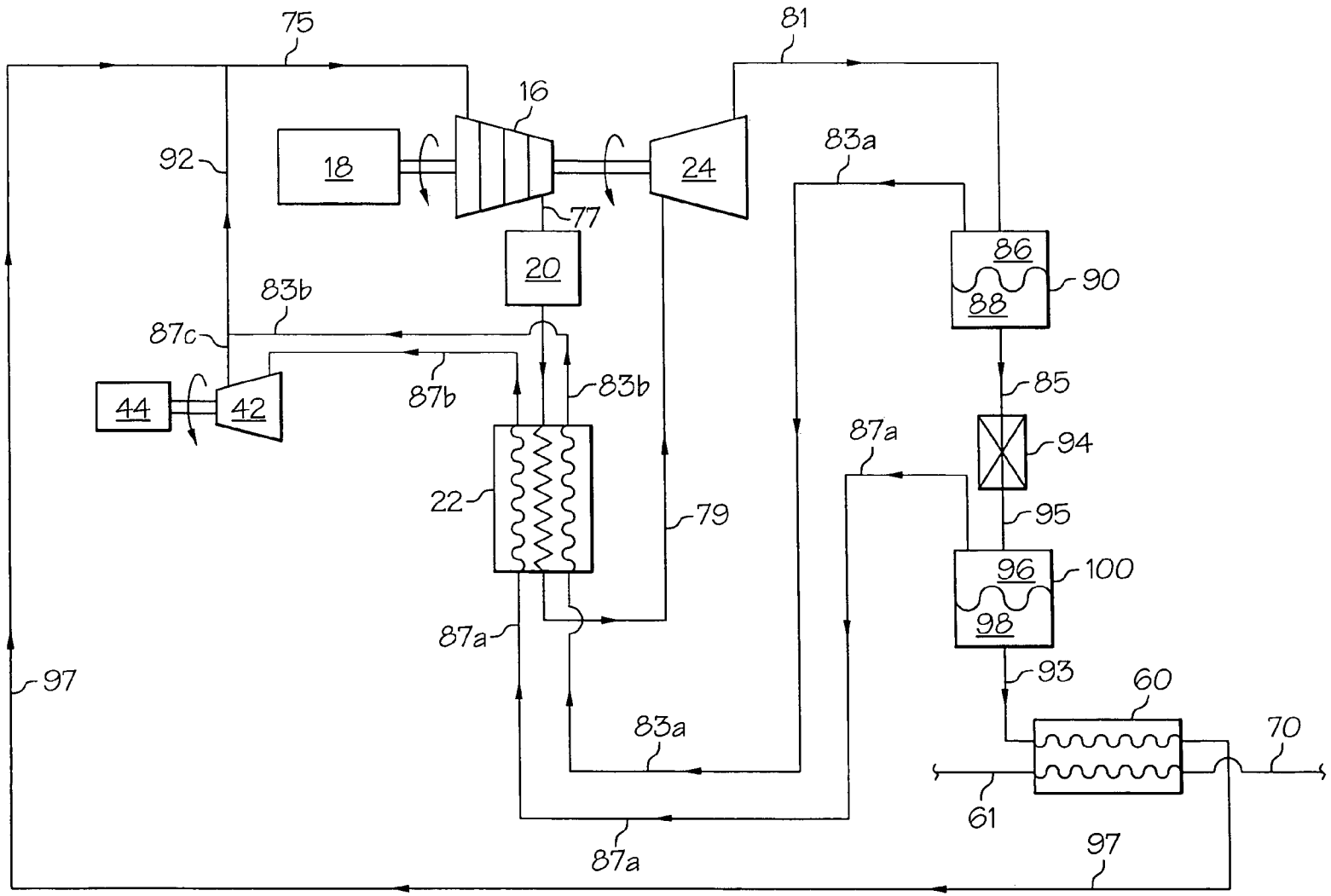
FIG. 3 is a schematic flow diagram showing a refrigeration system for generating cryogenic temperatures to about −245° F., according to one embodiment of the present invention.

The same basic method and apparatus illustrated in FIG. 1 may be employed in similar cycle operating conditions as a more efficient primary step in the liquefaction of other cryogenic and non-cryogenic gases such as, but not limited to, hydrogen, oxygen, argon, carbon dioxide, and/or in any type of refrigeration application requiring a temperature of about −245° F. or lower. As illustrated in FIG. 3, the apparatus can be utilized as a refrigeration system, capable of refrigeration at about −245° F. In this embodiment, the system is completely closed with no feed stream employed, except at time of system charging (not shown). Notably, a regeneration heat exchanger (evaporator) 60 is employed in place of a final storage tank to transfer the refrigeration effect to its end use. Starting from the top left portion of FIG. 3, stream 75, which has been charged with natural gas (typically methane), enters the liquefaction process and is compressed in multiple stages by multi-stage feed gas compressor 16, which is typically driven by any type of rotary shaft power device—here the natural gas engine driver 18. Stream 75 is passed multiple times through the multi-stage compressor 16 and the after-cooler 20. Stream 77 is then cooled further by passing through a multi-flow cryogenic heat exchanger 22, and the compressed and cooled feed stream 79 is expanded in a turboexpander 24 to lower the pressure, cool it further, and convert the previously gaseous feed stream to a bi-phase stream 81 consisting of a first refrigerated vapor component 86 and a first liquid component 88, which are collected into and separated by a primary separation tank 90. The first refrigerated vapor component 86 is then re-cycled through the system as first recovery stream 83*a*. Recovery stream 83*a* is directed back through the multi-flow cryogenic heat exchanger 22 to help cool feed stream 77 by indirect heat exchange. Stream 83*b* then exits the exchanger 22 and joins the second recovery stream 87*c* as it exits the booster compressor 42 to become recycle stream 92.

The first liquid component 88 exits the primary separation tank 90 as primary liquid stream 85 and is expanded through throttle valve 94, which lowers the pressure of the stream to form another bi-phase discharge stream 95 consisting of a second refrigerated vapor component 96 and a second liquid component 98. The second refrigerated vapor component 96 and the second liquid component 98 are then separated after collection in secondary separation tank 100, and the second refrigerated vapor component 96 is then re-cycled through the system as second recovery stream 87*a*. Second recovery stream 87*a*, like stream 83*a*, is directed through the multi-flow cryogenic heat exchanger 22 to help cool feed stream 77 by indirect heat exchange. After exiting the heat exchanger 22, stream 87*b* is then recompressed with a lift or booster compressor 42, which is driven by motor 44, exits as stream 87*c* and joins stream 83*b* to become recycle stream 92.

Returning to the secondary separation tank 100, the second liquid component 98 is introduced as stream 93 in to a regeneration heat exchanger (evaporator) 60 to transfer the refrigeration effect to its end use. As illustrated, incoming line 61, containing the material desired to be refrigerated, enters heat exchanger 60 and exits as a much cooler line 70, which then goes to cool an intended outside device. Stream 97 then exits exchanger 60 and is recycled back to join with stream 92 to become feed stream 75, which then begins another cycle through the system.

Figure 4:
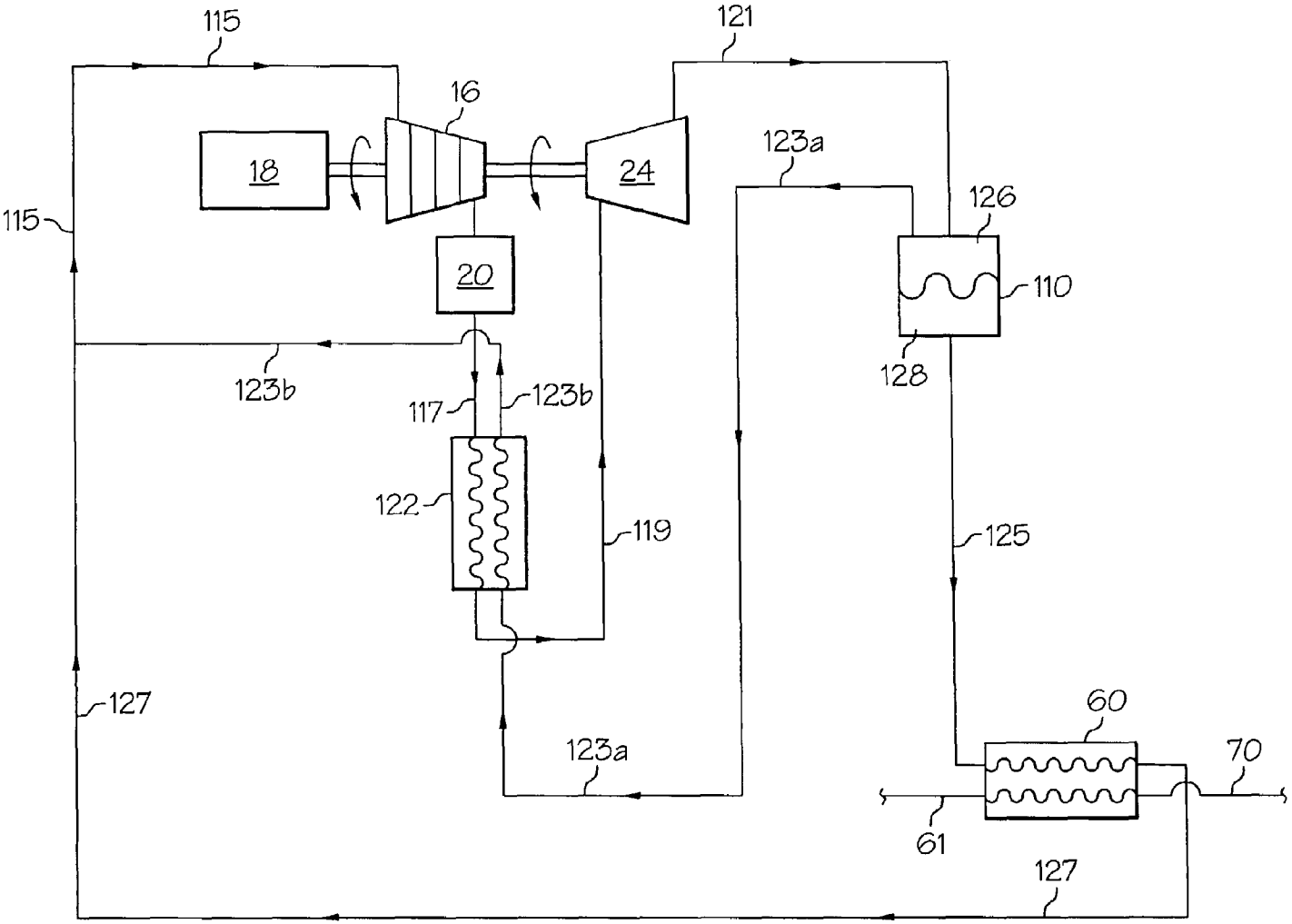
FIG. 4 is a schematic flow diagram showing a refrigeration system for generating cryogenic temperatures to about −185° F., according to one embodiment of the present invention.

In another embodiment of the invention the second reduction means can be eliminated to provide a compact refrigeration system capable of operating at temperatures in the −185° F. range for many commercial and industrial uses. As illustrated in FIG. 4, it is apparent that only one separation tank 110 is present in the system of this embodiment. Starting from the top right portion of FIG. 4, feed stream 115 enters the liquefaction process and is compressed and cooled in multiple stages by the multi-stage feed gas compressor 16 and after-cooler 20. As noted above, the compressor 16 is typically driven by a natural gas engine driver 18, but may also be driven by any type of rotary shaft power device. Stream 115 exits the multi-stage compressor 16 and after-cooler 20 combination and is then cooled further by passing through a multi-flow cryogenic heat exchanger 122. Thereafter, the compressed and cooled feed stream 119 is expanded in a turboexpander 24 to lower the pressure, cool it further, and convert the previously gaseous feed stream 119 to a bi-phase stream 121 consisting of a refrigerated vapor component 126 and a liquid component 128, which are collected and separated by separation tank 110. The refrigerated vapor component 126 is then re-cycled through the system as stream 123*a* and passes through multi-flow cryogenic heat exchanger 122 to help cool feed stream 117 by indirect heat exchange.

The liquid component 128 exits the separation tank 110 as primary liquid stream 125 and is introduced into a regeneration heat exchanger (evaporator) 60 to transfer the refrigeration effect to its end use. As illustrated, incoming line 61 enters heat exchanger 60 and exits as a much cooler line 70, which then goes to cool an intended outside device. After exiting the regeneration heat exchanger 60, stream 127 is recycled back to join with stream 123*b* and becomes feed stream 115, which re-enters the liquefaction cycle once again.

TABLE 1 shows a summary of typical cycle conditions for the present invention, determined from analysis and optimization of the process cycle using gas property data from the National Institute of Standards and Technology (NIST) Database 23 and NIST Reference Fluid Thermodynamic and Transport Properties (REFROP) versions 7.0 and 7.1. Million Standard Cubic Feed per Day (mmfscd) is the unit to measure gas volume at a standard condition of 14.7 psi and 60° F.

Figure 5:
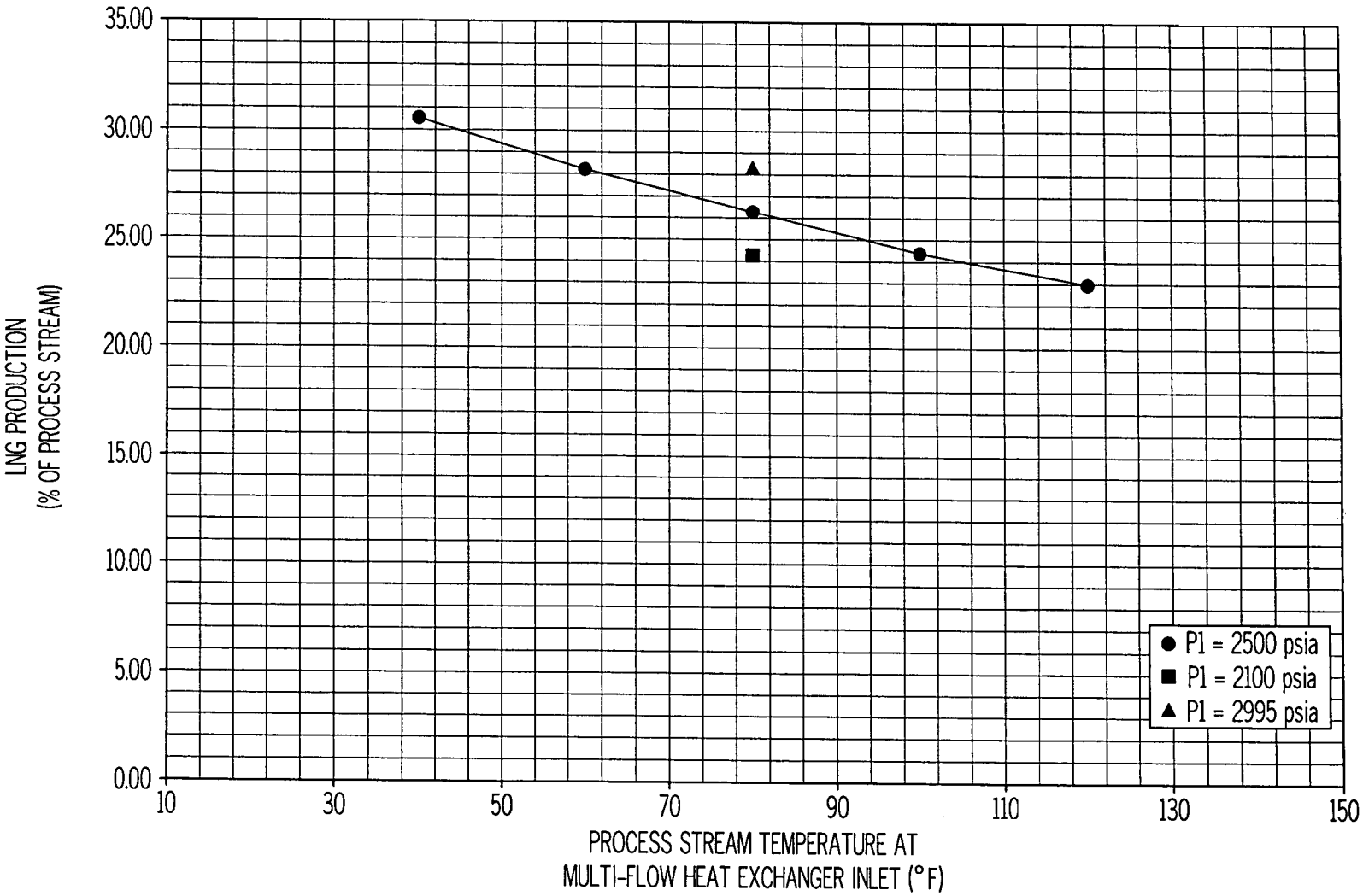
FIG. 5 is a graph showing the effect on LNG yield as a function of the temperature to which the pressurized feed stream is cooled prior to heat exchange.

Cases 1, 2a, and 3 of TABLE 1 show the effect of compressor discharge pressure on liquefaction using 100% methane gas as the feed gas, which shows that higher liquefaction yield rates are formed at higher pressure levels within the range shown. Similarly, the effect of gas temperature leaving the primary compressor after-cooler 20 is shown in FIG. 5, which illustrates that cooling the high-pressure feed stream, composed of 100% methane, after compression results in significantly higher rates of liquefaction. Such cooling can be accomplished with conventional air-to-gas fin-fan heat exchangers, or with shell-and-tube heat exchangers having an external cooling liquid source, such as water, or by other means.

Case 2b of TABLE 1 summarizes typical cycle conditions using a typical "pipeline quality" natural gas as the feed gas, consisting of 98.00% methane gas, 0.75% ethane, 0.50% propane, 0.20% normal butane, 0.25% nitrogen and 0.30% carbon dioxide. Case 2c of TABLE 1 summarizes typical cycle conditions using a representative field gas that is rich in carbon dioxide as the feed gas, consisting of 88.00% methane, 0.75% ethane, 0.50% propane, 0.20% normal butane, 0.25% nitrogen, and 10.30% carbon dioxide. Case 2d summarizes typical cycle conditions using a representative field gas that is also rich in nitrogen as the feed gas, consisting of 88.00% methane, 0.75% ethane, 0.50% propane, 0.20% normal butane, 10.25% nitrogen, and 0.30% carbon dioxide.

TABLE 1

| | Compressor Discharge | | | Expander Inlet | | Expander Discharge | | | | Throttle Valve Outlet | | | | LNG Production | |
|---|---|---|---|---|---|---|---|---|---|---|---|---|---|---|---|
| Case | Press psia | T ° F. | Flow mmscfd | Press psia | T ° F. | Press psia | Temp ° F. | Vapor % | Liquid % | Press psia | Temp ° F. | Vapor % | Liquid % | Liquid % | Power Output Hp |
| 1 | 2994.7 | 80 | 3.570 | 2964.7 | −29.0 | 125.7 | −196.7 | 63.4 | 36.6 | 19.7 | −252.0 | 22.6 | 77.4 | 28.3 | 103.9 |
| 2a | 2500 | 80 | 3.815 | 2470 | −29.8 | 104.7 | −203.5 | 67.4 | 32.6 | 19.7 | −252.0 | 19.7 | 80.3 | 26.2 | 113.6 |
| 2b | 2500 | 80 | 3.779 | 2470 | −29.8 | 104.7 | −202.2 | 67.4 | 32.6 | 19.7 | −251.9 | 18.9 | 81.1 | 26.5 | 112.5 |
| 2c | 2500 | 80 | 4.424 | 2470 | −27.5 | 104.7 | −201.3 | 72.4 | 27.6 | 19.7 | −251.9 | 18.1 | 81.9 | 22.6 | 122.4 |
| 2d | 2500 | 80 | 4.187 | 2470 | −29.4 | 104.7 | −207.4 | 68.3 | 31.7 | 19.7 | −261.0 | 24.8 | 75.2 | 23.9 | 113.5 |
| 3 | 2100 | 80 | 4.125 | 2070 | −32.9 | 87.8 | −209.7 | 70.8 | 29.2 | 19.7 | −252.0 | 17.1 | 82.9 | 22.2 | 126.7 |

The present invention can employ a sliding vane bi-phase turboexpander (numbered 24 in FIGS. 1, 3 and 4) to form a bi-phase stream of gas and liquid, namely the first refrigerated vapor component and the first liquid component. This type of turboexpander typically comprises a rotary mechanical turboexpander having radially sliding vanes that convert pressure, velocity and heat energy in the feed gas stream into power, thereby converting potential, kinetic and thermal energy from the gas stream into power. A portion of the natural gas feed can be condensed as LNG as the compressed and cooled feed gas is directed through and expands within the turboexpander. The sliding vane bi-phase turboexpander is typically capable of operation in pressure and temperature ranges that permit the condensation of a portion of the feed gas to liquid within its internal flow channels and passages. The turboexpander is thus able to operate with quantities of the condensed liquid that normally stifle current turboexpanders. Additionally, this machine is tolerant of this internal liquid formation without experiencing damage, excessive wear or loss of efficiency.

Figure 6:
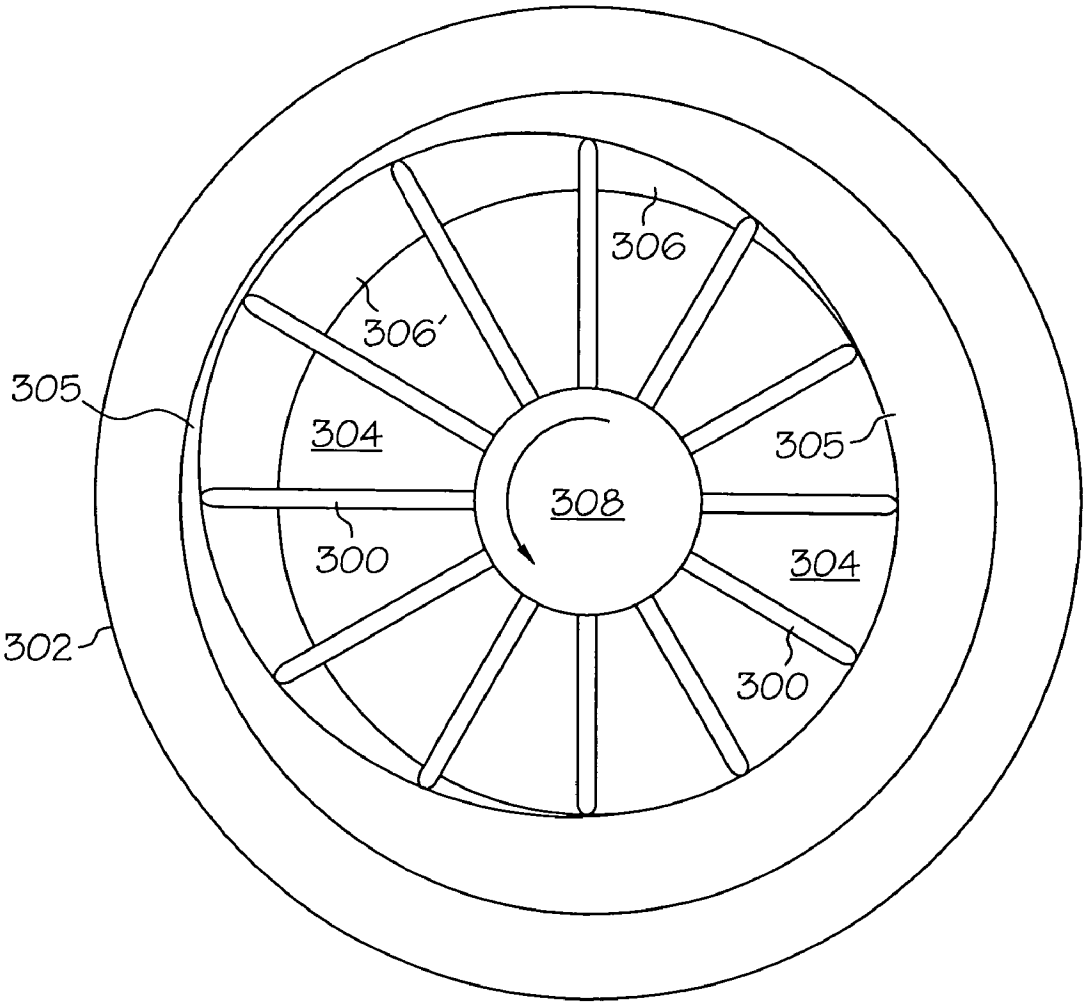
FIG. 6 is a cross-sectional view of one embodiment of a turboexpander of the present invention.

In general, the sliding vane bi-phase turboexpander uses advanced sliding vane positive displacement technology, rather than piston positive displacement or flow-through technology, and includes a polydynamic expansion chamber profile design. As illustrated in FIG. 6, radially sliding vanes 300 (typically, but not limited to, 12 vanes) are part of a rotor assembly and are enclosed by a polydynamic stator 302. The stator 302, which is the fixed part of the rotating machine enclosing the rotor 304, includes a "working" inner profile 305 which is flexible in design and therefore able to incorporate a polydynamic ellipse shape which the vane tips follow while reciprocating within the rotor 304 as it turns. As the sliding vanes 300 slide outwardly from the rotor axis 308, they form chambers 306, 306' between successive vanes for the incoming natural gas (not shown). These chambers 306, 306' expand in volume as the vanes rotate with the rotor 304 about the rotor axis 308 and within the inner profile of the stator 305. The expansion rates of the chambers, i.e. the rates at which the chambers between successive vanes grow, affect the efficiency of the turboexpander, and thus affect the efficiency of the method and apparatus of the current invention. The overall efficiency of the sliding vane bi-phase turboexpander can be more than 2.5 times greater than current turboexpanders.

The particular configuration of the polydynamic ellipse formed by the stator is in part a result of vane velocity and is determined by a comprehensive computer analysis of the gases to be utilized and the desired working parameters of the machinery. "Polydynamic Profile" refers to the shape of the expansion chambers 306, 306' within the stator inner profile 305. The chambers can form multiple shapes that include (but are not limited to) ellipses, radii, straight lines, angles, or portions thereof to form a profile that can match and maximize the operation of the turboexpander relative to expansion rate and ratio desired for the particular gases being employed, for maximum efficiency. Several features of the sliding vane bi-phase turboexpander described above include (1) Vane design permitting high pressure/very low temperature operation; (2) Chamber profile design permitting high pressure operation and high efficiency expansion characteristics from high pressure to much lower pressure in a single pass; and (3) Bearing and lubrication design which will permit high pressure, heavy load operation in extreme conditions.

Figure 7:
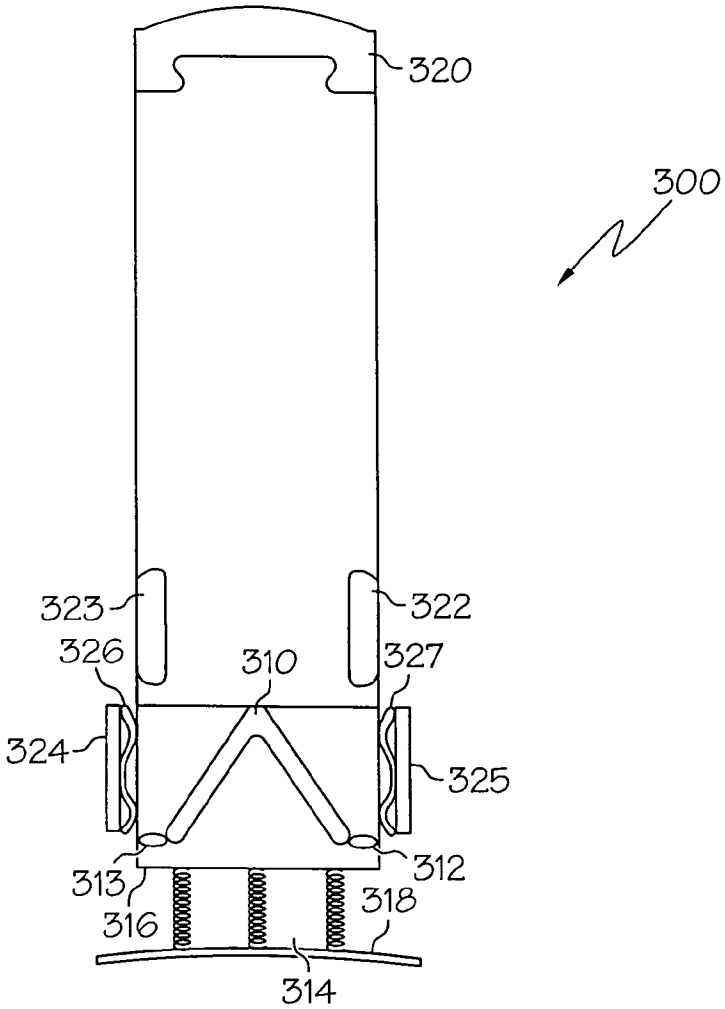
FIG. 7 is a perspective view of one embodiment of a sliding vane of the turboexpander of FIG. 6.

FIG. 7 shows a typical vane 300 of the sliding vane turboexpander, and includes a venting mechanism as an escape path for trapped liquid. As illustrated, a V-shaped groove 310 is cut into the face of each vane 300, with two small holes 312, 313 drilled therethrough for venting. In use, the groove 310 faces the "high pressure" side of its vane, facing away from rotor rotation. The holes lead to the spring well 314 for the vane. This venting design permits equalization of pressure under the vane, between vane bottom 316 and rotor groove bottom 318, thus aiding in maintaining a seal at the vane tip (the area where the vane contacts the stator chamber ellipse). Venting also permits a path to relieve any fluid accumulation under the vane in the spring well 314, thus preventing a "hydraulic lock" condition, where the vane is prevented from receding into its rotor groove, preventing rotor rotation and perhaps even causing structural damage to the turboexpander machinery. The venting mechanism is typically a timed event, with the vent closing when under full vane compression, and opening to equalize the pressure on extension.

Each vane 300 is typically made of stainless steel and includes replaceable wear surfaces (bearing tips) 320 which are employed in the rotor at the top of the vane slot as vane guides, to reduce friction in the vanes. These vane tips 320, which are separate inserts for each vane 300, are retained on the vane by a dovetail and are located at the top of the vane. The tips 320 are typically made of a low friction material, for example but not limited to TPFE (Teflon) impregnated bronze (trade name Permaglide®) that resists wear under heavy loads and at the same time conforms to distortions in the outer stator housing due to thermal or pressure influences. The vane tips 320 are designed as a replaceable wear element. Further, the vanes 300 typically include replaceable axial load-bearing inserts 322, 323, also designed as replaceable wear elements, which are retained by a dovetail near the bottom of the vane, across its face. These are also typically made of low-friction material such as Permaglide®, and are intended to take heavy loading while resisting/reducing friction and wear.

The vanes 300 also include side seal inserts 324, 325 at the lower end sides of the vanes, which are operable to seal the ends of the vane against the rotor housing. These side seal inserts 324, 325 are deliberately thin and flexible, permitting conformation to any distortions created in the turboexpander's side housings due to either thermal or pressure induced distortions. This is essentially a self-adjusting design feature that addresses a previously major leak path in this type of machinery. The seal inserts 324, 325 also provide a replaceable wear surface in an area of high loading. Each of the seal inserts 324, 325 are preloaded from behind with a flat waffle spring 326, 327 to assure a positive seal with the rotor housing.

The use of the sliding vane turboexpander described above is not limited to use in the present invention, and is also not limited to use with methane. Indeed, all cryogenic gases, including but not limited to nitrogen, oxygen, argon, etc., and bi-phase gases such as steam can be used with the sliding vane turboexpander.

The method and apparatus of the invention has many advantages over the prior art, and provides an improved process for the cryogenic refrigeration and liquefaction of gases. The apparatus is modular, compact, minimizes the ongoing costs of production and replacement equipment, and has increased efficiency compared to other liquefaction systems. For example, the present invention decreases and/or eliminates the number of external refrigeration circuits necessary in a liquefaction plant. It also provides a means to decrease the initial amount of capital investment needed to form a liquefaction plant, and provides a liquefaction plant that is small and simple in design, able to be easily and economically relocated from one site to another without significant operational down time, typically in several days' time. Indeed, the apparatus is compact and relatively light in weight and can be modularized (See FIG. 2). Further, high operating efficiencies and high liquid outputs in relation to size and costs make it commercially viable as a means to liquefy gases on site; whether it be at a natural gas pipeline terminal for an end user such as motor vehicle fleets, or at or near the well field for transporting the product as a liquid via pipeline, rail or truck to an end user. In the case of pipeline transport, the present invention has an advantage in a 600 to 1 reduction of product volume to liquid from gas. This means that a much smaller diameter pipeline can be used to transport an equal amount of BTU's, compared to a gaseous pipeline. Further, the present invention can be used in conjunction with an existing high-pressure feed stream, and provides an environmentally safe means to access natural gas resources, recover the natural gas, convert the natural gas to LNG, and transport the LNG to market.

While the present invention has been illustrated by the description of embodiments thereof, and while the embodiments have been described in considerable detail, it is not intended to restrict or in any way limit the scope of the appended claims to such detail. Additional advantages and modifications will be readily apparent to those skilled in the art. The invention in its broader aspects is therefore not limited to the specific details, representative apparatus and method, and illustrated examples shown and described. Accordingly, departures may be made from such details without departing from the scope or spirit of the invention.

What is claimed is:

1. A compact and modular apparatus for refrigerating and liquefying a gas such as pure methane or a natural gas stream rich in methane, the apparatus comprising:

a. a pre-compressor for compressing a low pressure, well-head gas stream to a high pressure compressed main feed stream at a pressure of between about 1500 psig and about 3500 psig and at near ambient temperature;

b. a means for cooling the compressed main feed stream to a temperature of between about −10° F. to about −100° F.;

c. a first expansion means configured to expand the cooled, compressed feed stream to form a first bi-phase stream comprising a first refrigerated vapor component and a first liquid component;

d. a primary separation tank configured to separate the first refrigerated vapor component and the first liquid component;

e. a second expansion means configured to connect directly to the primary separation tank, with no cooling means located between the first and second expansion means, to directly expand the separated first liquid component to form a second bi-phase stream comprising a second refrigerated vapor component and a second liquid component;

f. a secondary separation tank configured to separate the second refrigerated vapor component and the second liquid component; and g. a means configured for storage and transport of the separated second liquid component, wherein the apparatus is compact and modular and adapted for transport from one natural gas site to another.

2. The apparatus of claim 1, further comprising a means to place the separated first refrigerated vapor component into fluid communication with the compressed main feed stream.

3. The apparatus of claim 1, further comprising a means to place the separated second refrigerated vapor component into fluid communication with the compressed main feed stream.

4. The apparatus of claim 3, further comprising placing a gas stream which has evaporated from the liquefied gas in the means configured for storage and transport into fluid communication with the main feed stream.

5. The apparatus of claim 1, wherein the first expansion means is a sliding vane hi-phase turboexpander.

6. The apparatus of claim 1, wherein the means for cooling the compressed main feed stream is a multi-flow heat exchanger, and the second expansion means is a throttle valve.

7. The apparatus of claim 1, further comprising a regeneration heat exchanger configured to receive one of the first liquid component or the second liquid component as a cooling component therein.

8. A compact and modular apparatus for refrigerating and liquefying a gas such as pure methane or a natural gas stream rich in methane, the apparatus comprising:

a. a multistage compressor configured for receiving and compressing a main stream gas at a pressure of about 85 psig and at near ambient temperature to a pressure of between about 1500 psig to about 3500 psig;

b. an after-cooler configured to cool the compressed feed stream to near ambient temperature immediately after each compression stage in the multistage compressor;

c. a heat exchanger configured to cool the compressed feed stream to a temperature of between about −10° F. to about −100° F.;

d. a first expansion means configured to expand the compressed and cooled feed stream to a pressure of between about 15 to about 135 psig to form a first refrigerated vapor component and a first liquid component having a temperature of between about −155° F. to about −240° F.;

e. a primary separation tank configured to separate the first refrigerated vapor component and the first liquid component;

f. a second expansion means configured to connect directly to the primary separation tank, with no cooling means located between the first and second expansion means, to directly expand the first liquid component to a pressure of between about 3 psig to about 7 psig to form a second refrigerated vapor component and a second liquid component having a temperature of between about −250° F. to −265° F.;

g. a secondary separation tank configured to separate the second refrigerated vapor component and the second liquid component;

h. a means configured for storage and transport of the separated second liquid component; and i. a means to place the separated first refrigerated vapor component and the separated second refrigerated vapor component into fluid communication with the compressed main feed stream, wherein the apparatus is compact and modular and adapted for transport from one natural gas site to another.

9. The apparatus of claim 8, further comprising placing a gas stream which has evaporated from the liquefied gas in the means configured for storage and transport into fluid communication with the compressed main feed stream.

10. The apparatus of claim 8, further comprising a regeneration heat exchanger configured to receive the separated second liquid component as a cooling component therein, the regeneration heat exchanger operable to refrigerate an incoming line for a separate apparatus.

11. The apparatus of claim 10, further comprising a means to place the separated second liquid component, the separated first refrigerated vapor component and the separated second refrigerated vapor component into fluid communication with the compressed main feed stream.

12. The apparatus of claim 8, wherein the multi-stage compressor includes a drive means selected from the group consisting of a gasoline engine, a natural gas driver, an electric motor, a diesel engine, a gas turbine, a steam turbine, and any other suitable driver.

13. A compact and modular apparatus for compressing, refrigerating and liquefying a natural gas stream rich in methane, the apparatus comprising:

a) a multistage compressor configured for receiving and compressing a main stream gas at a pressure of about 85 psig and at near ambient temperature to a pressure of between about 1500 psig to about 3500 psig;

b) an after-cooler configured to cool the compressed feed stream to near ambient temperature immediately after each compression stage in the multistage compressor;

c) a heat exchanger configured to cool the compressed feed stream to a temperature of between about −10° F. to about −100° F.;

d) an expansion means configured to expand the compressed and cooled feed stream to a pressure of between about 15 to about 135 psig to form a first refrigerated vapor component and a first liquid component having a temperature of between about −155° F. to about −240° F.;

e) a primary separation tank configured to separate the first refrigerated vapor component and the first liquid component;

f) a regeneration heat exchanger configured to receive the separated first liquid component as a cooling component at a temperature of between about −155° F. to about −240° F., the regeneration heat exchanger operable to refrigerate an incoming line from a separate device; and g) a plurality of skids adapted to transport the apparatus, wherein the apparatus is compact and modular and is adapted for either temporary or permanent use, and wherein the plurality of skids are adapted for transporting the multistage compressor, the after-cooler, the heat exchanger, the turboexpander and the separation tank from one natural gas site to another.

14. The apparatus of claim 13, wherein the plurality of skids comprises a first skid configured to transport the after-cooler, a second skid configured to transport the multistage compressor and its driver, the heat exchanger, and the expansion means, and a third skid configured to transport the primary separation tank.

15. The apparatus of claim 13, wherein the plurality of skids can be readily shipped via public roads, and wherein each of the plurality of skids is between about 10 feet to about 16 feet wide, between about 25 feet to about 60 feet long, and wherein each of the plurality of skids weighs no more than 60 tons.

16. The apparatus of claim 13, wherein one of the plurality of skids further includes a Control Panel for housing a main computer or programmable logic controller for operating the apparatus.

17. The apparatus of claim 13, wherein the plurality of skids are further adapted to transport auxiliary coolers, a booster compressor, an electrical generator or alternator, and a natural gas engine driver.

* * * * *